United States Patent [19]

Pippin

[11] 4,192,359

[45] Mar. 11, 1980

[54] CONTAINER FILLING APPARATUS AND METHOD

[76] Inventor: Roy L. Pippin, P.O. Box 1077, Plant City, Fla. 33566

[21] Appl. No.: 849,172

[22] Filed: Nov. 7, 1977

Related U.S. Application Data

[63] Continuation-in-part of Ser. No. 808,657, Jun. 21, 1977, abandoned.

[51] Int. Cl.[2] ..... B65B 1/04

[52] U.S. Cl. ..... 141/12; 141/80; 141/125; 141/129

[58] Field of Search ..... 141/1-12, 141/115-127, 129-191, 71-80; 100/100

[56] References Cited

U.S. PATENT DOCUMENTS

| | | | |
|---|---|---|---|
| 3,839,852 | 10/1974 | Jebens | 100/100 |
| 3,958,612 | 5/1976 | Fränzl | 141/12 |

FOREIGN PATENT DOCUMENTS

| | | | |
|---|---|---|---|
| 273038 | 6/1927 | United Kingdom | 141/125 |

*Primary Examiner*—Houston S. Bell
*Attorney, Agent, or Firm*—Stein & Frijouf

[57] ABSTRACT

Container filling apparatus and method are disclosed in a form for loading green beans into containers, such as hampers, boxes, crates and the like. A conveyor deposits the beans onto a turntable having a continuous series of ports along its peripheral portion for passage of the beans into the containers below the ports. Beans which do not drop through the ports remain on the turntable and are carried to a first rotary unit which propels the beans in a direction opposite the rotational direction of the turntable and at least partially into the ports to substantially fill the containers. The rotary units are above the path of the ports and remove excess beans from atop the ports. A compactor for the beans in the containers is provided along the path of the ports immediately downstream of the rotary unit, to eliminate voids between the beans and the beans on the turntable are carried to a second rotary unit which again propels the beans away from itself for ultimate removal through the ports. The containers are received on and removed from an elevating system which raises each container into engagement with a peripheral lip of an associated one of the ports and then lowers the container after one revolution with the turntable.

18 Claims, 8 Drawing Figures

CONTAINER FILLING APPARATUS AND METHOD

CROSS REFERENCE TO RELATED APPLICATIONS

This application is a continuation-in-part of my copending U.S. Pat. application Ser. No. 808,657, filed June 21, 1977, now abandoned, which is hereby incorporated by reference herein.

BACKGROUND OF THE INVENTION

1. Field of the Invention

This invention relates to a container filling apparatus and method and, more particularly, to such apparatus and method for loading beans into containers.

2. Description of the Prior Art

Numerous types of apparatus and methods are known for automatically loading containers, and many utilize the turntable principle as shown in the following U.S. Pat. Nos. 939,455; 1,828,936; 2,279,371; 2,289,852; 3,285,294; 3,295,566; 3,554,412 and 3,919,828. Many of these patents also show elevating systems for lifting containers into filling engagement with a bottom portion of the turntable for passage of the material through ports in the turntable and into the containers. Some of the patents also show various ways of compacting the material in the containers.

For example, U.S. Pat. No. 939,455 shows a machine for filling boxes which are carried on a rail and elevated thereby into filling associations with openings in a turntable which carries the material to be discharged into the boxes. Rotary assemblies have arms to compact the material in the boxes. In U.S. Pat. No. 1,828,936 cans to be filled are deposited on platens which are elevated by an annular cam track so that the open top ends of the cans are telescoped about collars on a turntable. In U.S. Pat. No. 2,279,371 cans are deposited on elevating plungers which move up an incline of a partial annular track to elevate the open tops of the cans about depending lips of a circular turntable top. Produce is deposited on the turntable and falls through holes defined by the lips and into the cans. A fixed deflector moves the produce away from these holes and into a central portion of the turntable in the area between the filled can removal station and the empty can supply station. In U.S. Pat. No. 2,289,852 cans are deposited onto a stationary annular track and between fingers of a turntable which moves the cans along the track, the track elevating the cans into engagement with fixed annular lips about loading ports in a turntable. A packer wheel compacts the material which has been deposited in the cans. A wiper is provided downstream of the filling station. U.S. Pat. No. 3,285,294 shows an annular track which elevates cans into engagement with annular flanges about filling openings in a plate. Curved deflectors ride on an upper plate for deflecting the filling material into chambers. U.S. Pat. No. 3,295,566 shows a filling machine for comminuted materials in which containers to be filled are elevated by a partial annular rail and are telescoped above sleeves a turntable. Generally spiral baffles urge the material toward the periphery of the turntable. U.S. Pat. No. 3,554,412 shows a capable charging system in which annular cam track operates plungers for raising and lowering capsules filled with powder which is compacted by a plunger (FIG. 6), and the capsules may be subjected to a second filling before being cleaned by brushing and then capped. Stationary deflectors (FIG. 10) position the powder on a turntable of the apparatus, and similar deflectors are shown in FIG. 14. U.S. Pat. No. 3,919,828 shows a pickle packing machine with a turntable carrying pickle jars from station to station. It also shows plunger assemblies, one for each of the jars, these assemblies traveling with the turntable and being pressed by a fixed cam for compacting the pickles.

It is an object of this invention to provide a new and useful container filling apparatus and method of filling containers. A related object is provision of such an apparatus and method in which the containers are filled with elongated material and, more particularly, are filled with pole beans.

Another object is provision of a new and useful container filling apparatus in which the material to be filled into the containers is deposited on a rotating turntable for passage through ports along the periphery of the turntable and into the containers therebelow, with provision for propelling the material on the turntable opposite the direction of rotation of the turntable and into the ports. A related object is provision of such propelling mechanism which propels the material away from the mechanism. Another related object is provision of an embodiment of such filling apparatus in which a first such propelling mechanism moves the material toward a center portion of the turntable so that the material bypasses the first propelling mechanism and is carried by the turntable to a second propelling mechanism extending into the center portion of the turntable for receiving this material and propelling the material into the ports. Another related object is provision of mechanism for compacting the material in the containers to reduce voids between the material while leaving the material in tact, the compactor being between the first and second propelling mechanisms in the direction of rotation of the turntable. Still another related object is provision between the compactor and the second propelling mechanism of an area for inserting empty containers into the apparatus and removing filled containers from the apparatus, the containers normally making two revolutions with the turntable as they are being filled. A further related object is provision of such apparatus in which the material is elongated, such as pole beans, and both propelling mechanisms are rotary brushes. Another related object is provision of a preferred embodiment in which the propelling mechanism is immediately down stream of the receiving area of the material onto the turntable and levels any mounds of such material while propelling the material away from itself and opposite the direction of movement of the turntable and into the ports, with the material passing the first propelling mechanism moving to a second propelling mechanism which similarly moves the material away from itself and into the ports and any material remaining on the surface of the turntable into engagement with a guide which orients the remaining material in a generally annular path on the turntable for passage of the material to a point immediately upstream from the receiving area of the material on the turntable and into the port and containers associated therewith from which these containers pass through the previously described cycle. The first propelling mechanism is in the form of a rotary fork and the second propelling mechanism is in the form of a rotary brush, with compacting mechanism between the two propelling mechanisms for reducing voids between the material in the containers while leaving the material in tact. A further related object is provision in such apparatus for rotating the turntable step by step for substantially uniform filling of the containers.

Still another object is provision of a new and useful method of filling containers including the steps of rotating about its axis a turntable having a series of ports spaced apart along a circular path proximate its periphery and substantially coaxial with the rotational axis of the turntable for passage of the material through the ports and into associated ones of the containers, depositing the material on the turntable for receipt by the ports, and propelling the material along the turntable in a substantially predetermined direction generally opposite the direction of rotation of the turntable while moving the material into the ports. Related objects include the step of compacting the material in the containers to reduce voids therebetween while leaving the material in tact; and the step of propelling the material including removing excess quantities of material from atop the ports for movement through other ports. Another related object includes in one embodiment, moving the material to a central portion of the turntable, and propelling the material from the central portion into the ports, the material being elongated, and in which the depositing step includes deposits the material on the turntable in generally parallel orientation, and the propelling steps substantially maintain the parallel orientation in propelling the material to the ports. Further related objects include in a preferred environment, depositing material remaining on the turntable in an annular path along the surface of the turntable and depositing this material into containers immediately upstream of the area in which the turntable initially receives the material; initially propelling the material by operation of a rotary fork to level the material and subsequently propelling the material into the annular path by operation of a rotary brush; and rotating the turntable step by step for uniform filling.

The invention, in brief, is directed to a new and useful container filling apparatus and method for filling containers wherein the material to be loaded into the containers is deposited on a rotating turntable for passage through ports along the periphery of the turntable and into the containers. As the turntable rotates the material thereon is propelled by a first mechanism in a direction opposite the direction of rotation of the turntable for passage through the ports with the material by-passing this mechanism passing to second mechanism which also propells the material away from itself and positions the material for passage through the ports. Compacting of the material in the containers is preferably provided between the first and second propelling mechanisms. In one embodiment the first mechanism propells the material toward a center portion of the turntable where it travels with the turntable to a second area at which the material is picked up from the center portion and is propelled by the second mechanism into the ports. A pair of rotary brushes for propelling the material is preferably provided; and with the material being elongated (pole beans, for example), it is preferably delivered to the turntable by a conveyor discharging above the ports and between the first and second rotary brushes with beans generally parallel to each other and remaining paralleled as they are delivered to the containers. In a preferred embodiment the first mechanism is preferably in the form of a rotary fork which propels the material away from itself and toward the ports, and levels any mounds of the material deposited on the turntable, with material passing this first mechanism being compacted in the containers and material remaining on the surface of the turntable passing to the second mechanism, preferably in the form of a rotary brush for propelling the material away from itself and into the ports, with material remaining on the surface of the turntable being propelled to a guide which forms this material into an annular path on the surface of the turntable for subsequent deposit in empty containers just upstream of the area at which the turntable originally receives the material, whereupon these last mentioned containers pass through the previously described cycle. The turntable may be rotated step by step, if desired, to assure substantially uniform filling of the containers.

These and other objects and advantages of the invention will be apparent from the following description and the accompanying drawings.

DESCRIPTION OF THE ILLUSTRATED EMBODIMENTS

Figure 1:
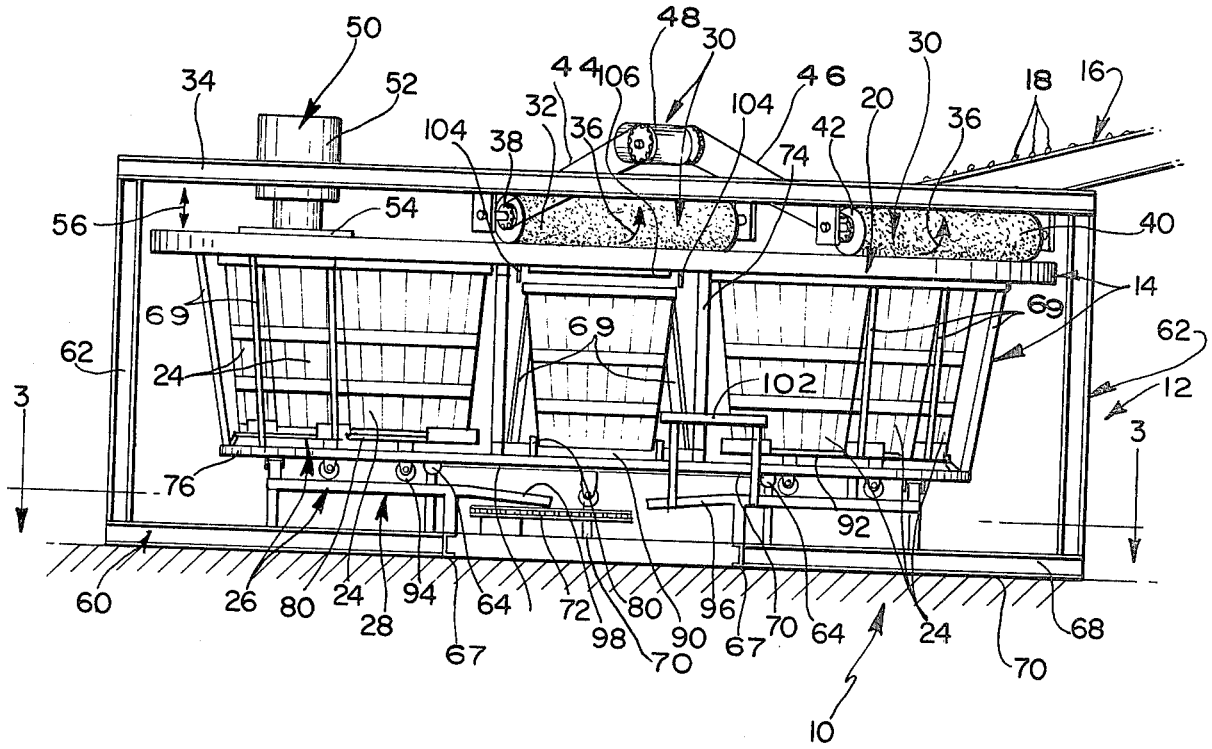
FIG. 1 is a schematic, elevational view of an embodiment of apparatus for filling containers with elongated beans.
Figure 2:
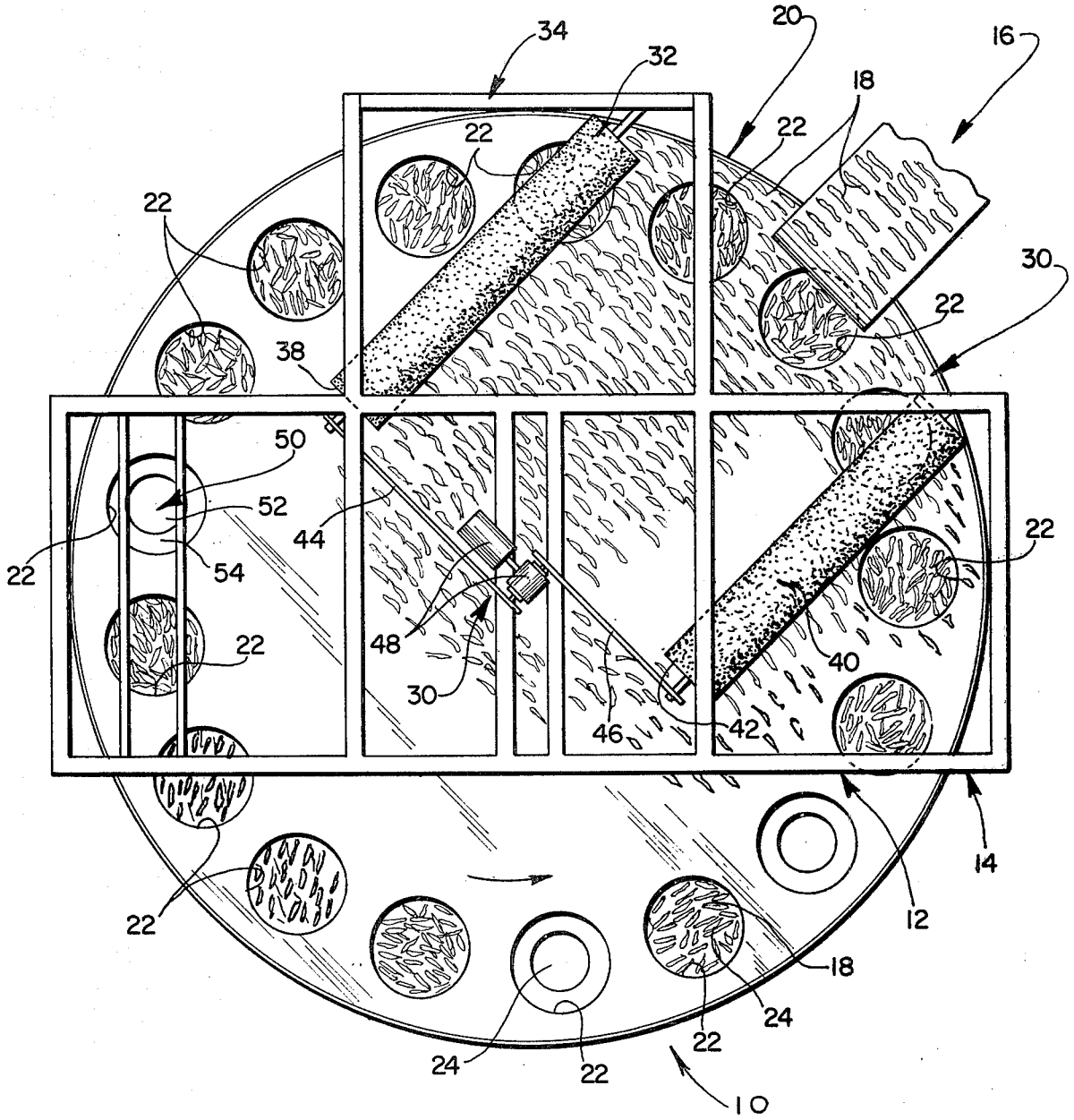
FIG. 2 is a schematic, top plan view of the apparatus shown in FIG. 1.

Referring to the drawings, and initially to FIGS. 1 and 2, the container filling apparatus 10 includes a stationary base unit 12 received on a suitable supporting surface and rotatably mounted on the base unit a turntable unit 14. Any form of suitably conveyor 16, such as a vibratory conveyor or a belt conveyor as shown, delivers elongated material, such as beans 18, in substantially paralled orientation, onto the top surface of a generally horizontal and cylinderical turntable 20, which is preferably a steel plate, or the like, with an annular upright side wall 21 for retaining the beans 18 on the turntable, and forms part of the turntable unit 14. A continuous, circular path of spaced apart ports 22 open through the turntable 22 for passage of the beans 18 therethrough and into suitable containers 24 directly below the ports and received on an elevating system 26 which carries the containers on the turntable unit 14 and includes a generally annular track 28 forming part of the base unit 12, as will be more fully described later.

Any suitable form of container 24, such as the usual boxes or crates, or hampers, as shown, may be filled with beans 18, by adapting the shape of the ports 22, and modifying the elevating system 26 in an obvious manner.

Conveyor 16 has its discharge end spaced slightly above the turntable 20 and partially overlapping the ports 22 so that beans 18 not deposited directly into the ports drop onto the turntable 22 still in substantially parallel orientation. As the beans move with the rotating turntable top they are propelled opposite the direction of rotation of the top by a propelling assembly 30 including a first bean propelling rotary brush 32 suitably journaled on and below a top frame unit 34 of the base unit 12, with the bottom of the brush lightly seated on the top surface of the turntable 20. Rotary brush 32 is driven in the direction indicated by the arrow 36 to propel the beans away from itself and in a direction opposite direction of rotation of the turntable 20. A portion of the beans so propelled move through adjacent ones of the ports 22 and drop into the containers 24. As the remaining beans are propelled away from the brush 32, they are moved in a direction generally normal to the longituding axis of the brush, and with rotation of the turntable 20 in a circular direction these beams are progressively moved toward the center of turntable 20 and into an inner central portion of the turntable from which they are carried by the turntable past the inner extremity 38 (FIG. 2) of the brush 32 and are carried to a second rotary brush 40 downstream of the first rotary brush 32. Longitudinal axes of the brushes are parallel to each other. The inner extremity 42 of the second brush 40 extends into the central portion of the turntable 20 to receive the beans therein and propels these beans away from itself and into the adjacent ports 22. The two brushes 32 and 40 are connected by chain drives 44 and 46, respectively, with opposite sprockets of an electric motor and transmission assembly 48 mounted on the top frame 34 of the stationary base unit 12.

A suitable compactor assembly 50 is mounted on the stationary, upper frame 34 for compacting the beans in the containers 24. The compactor assembly 50 may be of any suitable type, for example, a hydraulically driven compactor is operated very rapidly in opposite directions, (as indicated by the arrow 56 in FIG. 1), as by a hydraulic cylinder 52 connected with a compacting head 54, the compactor being timed to engage and lightly compact the beans in a container 24 and to be withdrawn within the time required for the container to pass the head 54. Any suitable form of timing means may be provided, such as an electric eye unit responsive to passage of each container 24, or a mechanically actuated system or any other suitable system, none of which is shown as the same is well known in the art.

Figure 3:
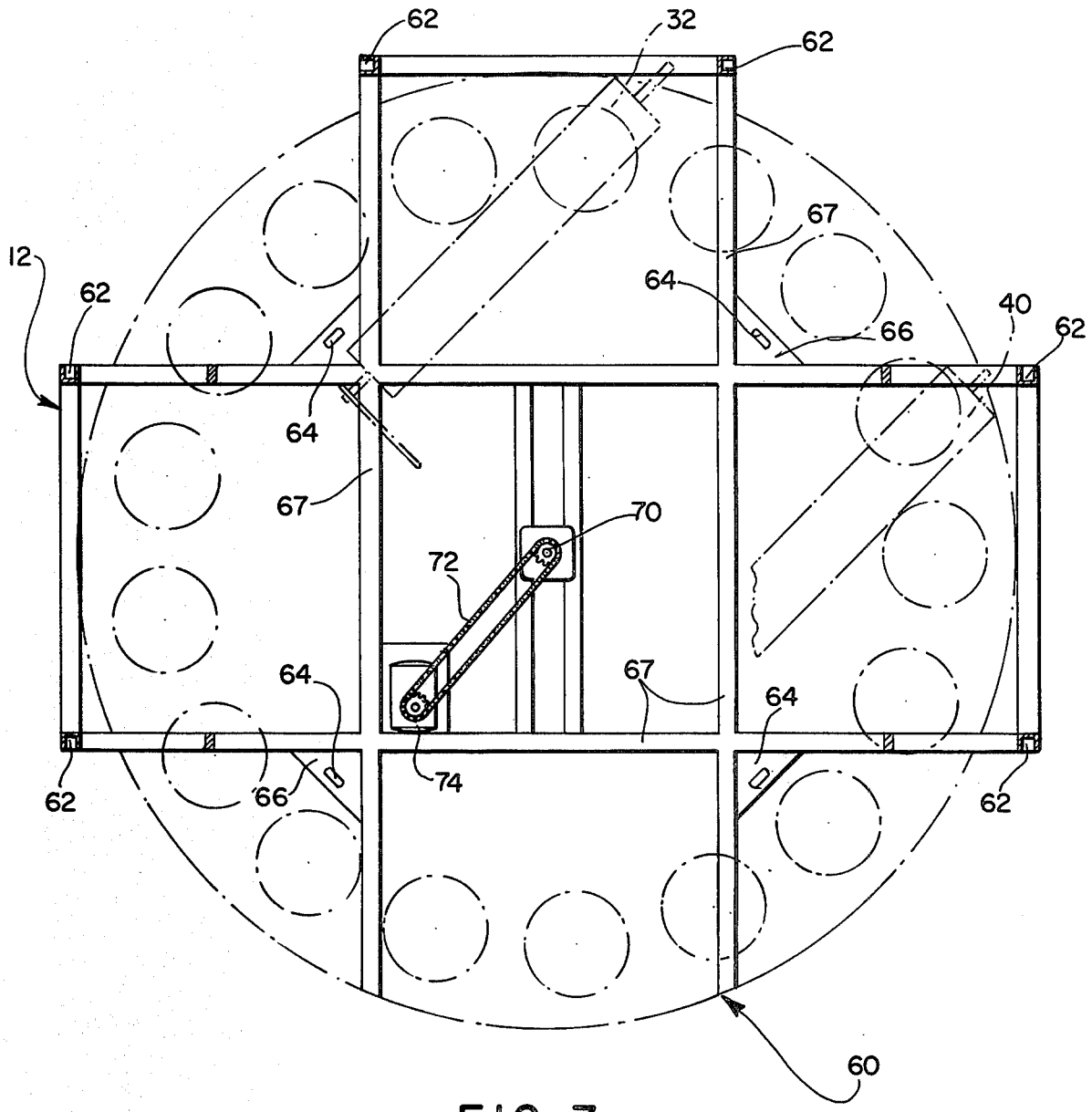
FIG. 3 is a schematic, sectional plan view of a lower portion of the apparatus, and is taken generally along the line 3—in FIG. 1, with portions of the upper structure as shown in FIG. 2 being indicated by phantom lines to better relate these two views to each other.

The stationary, base unit 12 which supports the turntable unit 14 includes, in addition to the upper frame 34, a lower frame 60 as shown in FIG. 3, with portions of the turntable 20 and the rotary brushes 32 and 40 indicated by phantom lines for purposes of orientation. Upper frame 34 is surmounted on the lower frame 60 by fixed uprights 62. Four wheel 64 are mounted on and extend upwardly from triangular plates 66 fixedly secured to adjacent corners of intersecting cross members 67 of the lower frame 60, and these wheels 64 receive a annular, downwardly opening channel track 68 (FIG. 1) of the turntable unit 14, the track 68 being suitably fixed to radial trusses 69 of the turntable unit 14 for rotation of the turntable about an upright axis defined by a shaft 70 (FIGS. 1 and 3). Shaft 70 of the turntable unit 14 is suitably journalled on the base unit 12 and is connected through a chain-drive 72 with an electric drive motor 74 fixed on the lower frame 60 of the base unit 12.

Figure 4:
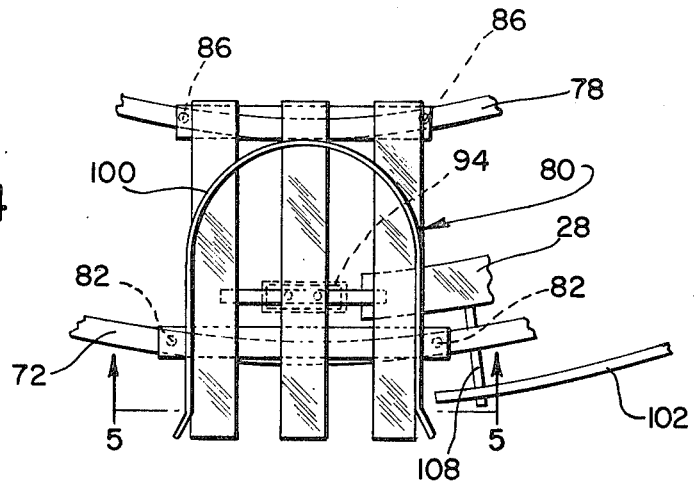
FIG. 4 is an enlarged, schematic plan view of a portion of a container elevating system of the apparatus shown in FIG. 1.
Figure 5:
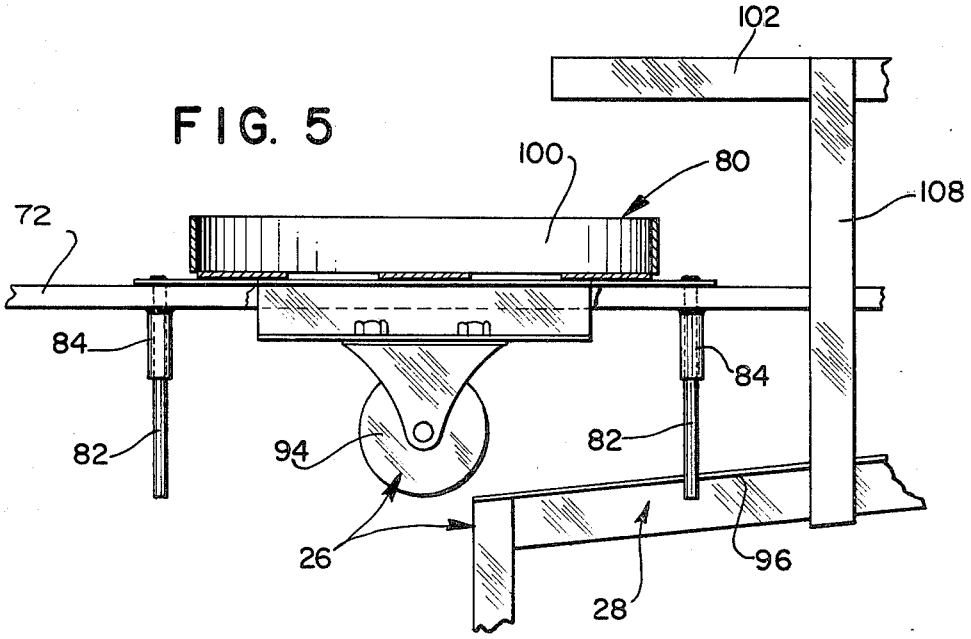
FIG. 5 is a further enlarged schematic elevational view of the structure shown in FIG. 5, in a first step of the elevating sequence.
Figure 6:
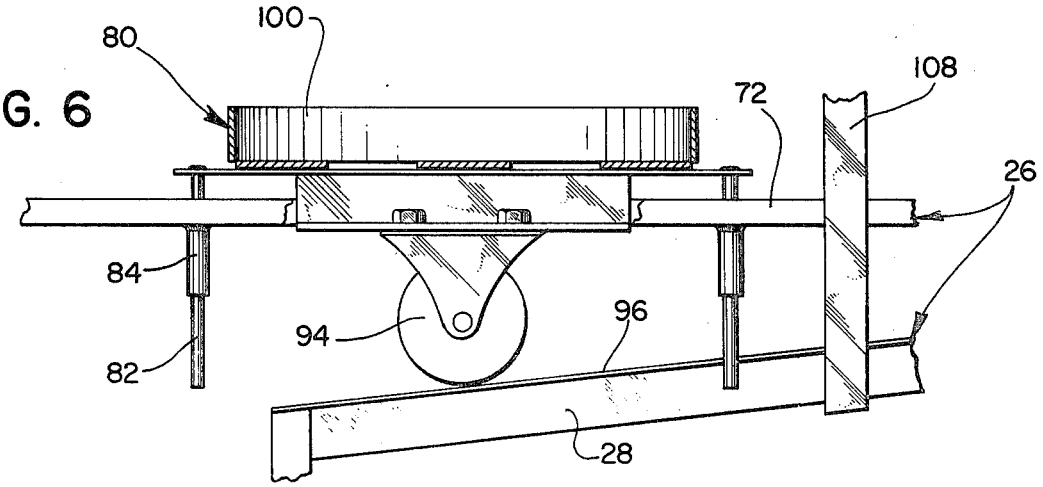
FIG. 6 is a view similar to FIG. 5 but during a second step of the elevating sequence.

The elevating mechanism 26 for the containers 24 includes the previously mentioned generally annular track 28 forming part of the stationary base unit 12, and annular frame members 76 and 78 forming part of the turntable unit 14. As shown in FIG. 4–6, the elevating mechanism 26 further includes a plurality of elevating platens 80 (FIG. 1) having a pair of depending rods 82 telescopically extending through sleeves 84 fixed to the annular frame 72, and rearwardly thereof similar rods 86 (FIG. 4) telescopically extending through similar sleeves (not shown) secured to the annular frame member 78, for reciprocal vertical movement of the platen 80 between a lowered position as shown in FIG. 5, and at 90 in FIG. 1, and an elevated position as shown at 92 in FIG. 1. In movement between the lowered and elevated positions, a depending wheel 94 of the platen 80 engages an inclined ramp portion 96 of the track 28 and rides up the track as shown in FIG. 6 to elevate its platen. As the platen 80 is about to complete one revolution, its wheel 94 rides down a declining ramp 98 (FIG. 1) and the platen returns to its lowered position 90 (FIG. 1) and as shown in FIG. 5.

Each platen includes a generally "U" shaped, vertical wall 100 for receiving the bottom of the container 24. As the platen 80 and its container move to the right from the lowered position 90 in FIG. 1, the container is engaged by a camming guide 102 (FIGS. 1, 4 and 5) which at its left end is further from the annular frame member 76 than at its right end to urge the container inwardly and against suitable guides 104 (FIG. 1) depending from the bottom face of the turntable 20, thereby orienting the container with an annular rim or lip 106 forming a continuous side of the associated port 22. Guide 102 may be fixedly secured to the outer annular frame member 76 as by supports 108 extending outwardly from the bottom of the track 28 and then upwardly to the outside of guide 102.

In summary, to follow the path of a container 24 to be filled with beans, the empty container is positioned on a platen 80 in its lowered position 90 as shown in FIG. 1. Upon continued rotation of the turntable unit 14 to the right as seen in FIG. 1, the platen roller 94 rides up the incline 96 of the track 28 whereupon the container 24 engages the guide 102 and is urged inwardly to seat against the inner portion of the U-shaped wall 100 of the platen and also against the guides 104 on the underside of the turntable 20 before the container is raised high enough for its upper rim to seat about the annular lip 106 of the port 22. The container then continues its journey with the turntable unit 14 and is loaded with beans first upstream of the second rotary brush 40; and then between this rotary brush and the first rotary brush 32 as the beans drop from the conveyor 16 into the adjacent ports 22 and onto the turntable top 20. As the container 24 continues moving with the turntable unit 14, the beans are compacted by the compactor assembly 50 and the container continues to move to the declining portion 98 of the track 28 and into its lowered position 90 (FIG. 1). Normally, the container will remain on its platen 80 and will make another revolution with the turntable unit 14 to assure that it is filled with beans. After the second revolution, as the container 24 again returns to its lower position 90 (FIG. 1), it is removed from the filling apparatus.

To review the travel of the beans, they are deposited in generally parallel orientation by the conveyor 16 onto the turntable 20, a portion of the beans passing through the ports 22 and the remainder traveling with the turntable 20 to the first rotary brush 32. This rotary brush propels the beans away from itself in a direction generally normal to its longitudinal axis with the beans eventually being moved either into ports 22 or to a center portion of the turntable 20 where they pass the inner extremity 38 of the first rotary brush 32 and pass to the second rotary brush 40. Brush 40 also propels the beans across the turntable 20 opposite the direction of rotation of the top and these beans pass into adjacent ports 22 as they are directed toward the right as viewed in FIG. 2 and thus the ports. As previously noted, the beans in the containers are compacted by the compactor assembly 50, and after two revolutions are removed from the filling apparatus.

For filling conventional bean hampers 24 of about 16" diameter and 24" height, a 10' diameter turntable 20 having seventeen equally spaced ports 22 of about 15" diameter is satisfactory. Rotational speed of the turntable 20 may be varied in any suitable manner depending on characteristics of the beans 18, the quantity to be processed in a given period, and the help available. A normal rate is about 2 rpm. Stiff fiber brushes 32 and 40 of about 8" diameter are suitable, and their rotational speed should be adjusted to propel the beans 18 about a foot or two.

Figure 7:
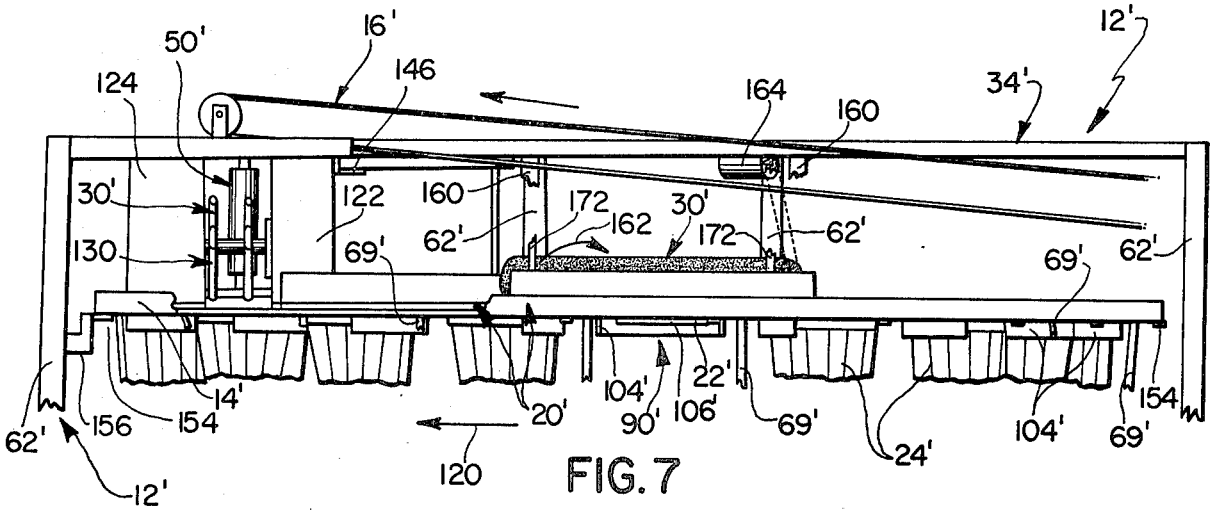
FIG. 7 is a fragmentary, schematic, elevation view, generally similar to FIG. 1, but of a preferred embodiment of the apparatus, with parts broken away and removed for clearer illustration.
Figure 9:
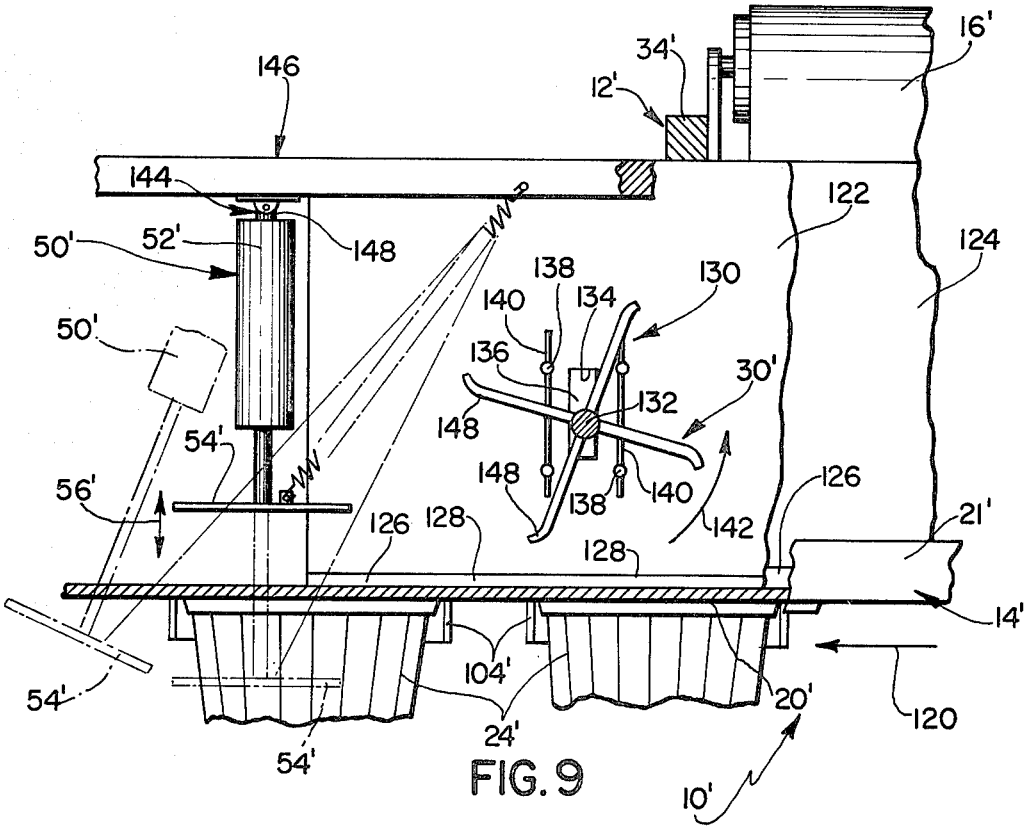
FIG. 9 is a fragmentary, enlarged, developed sectional elevational view of a portion of the apparatus taken generally along the line 9—9 in FIG. 8.
Figure 8:
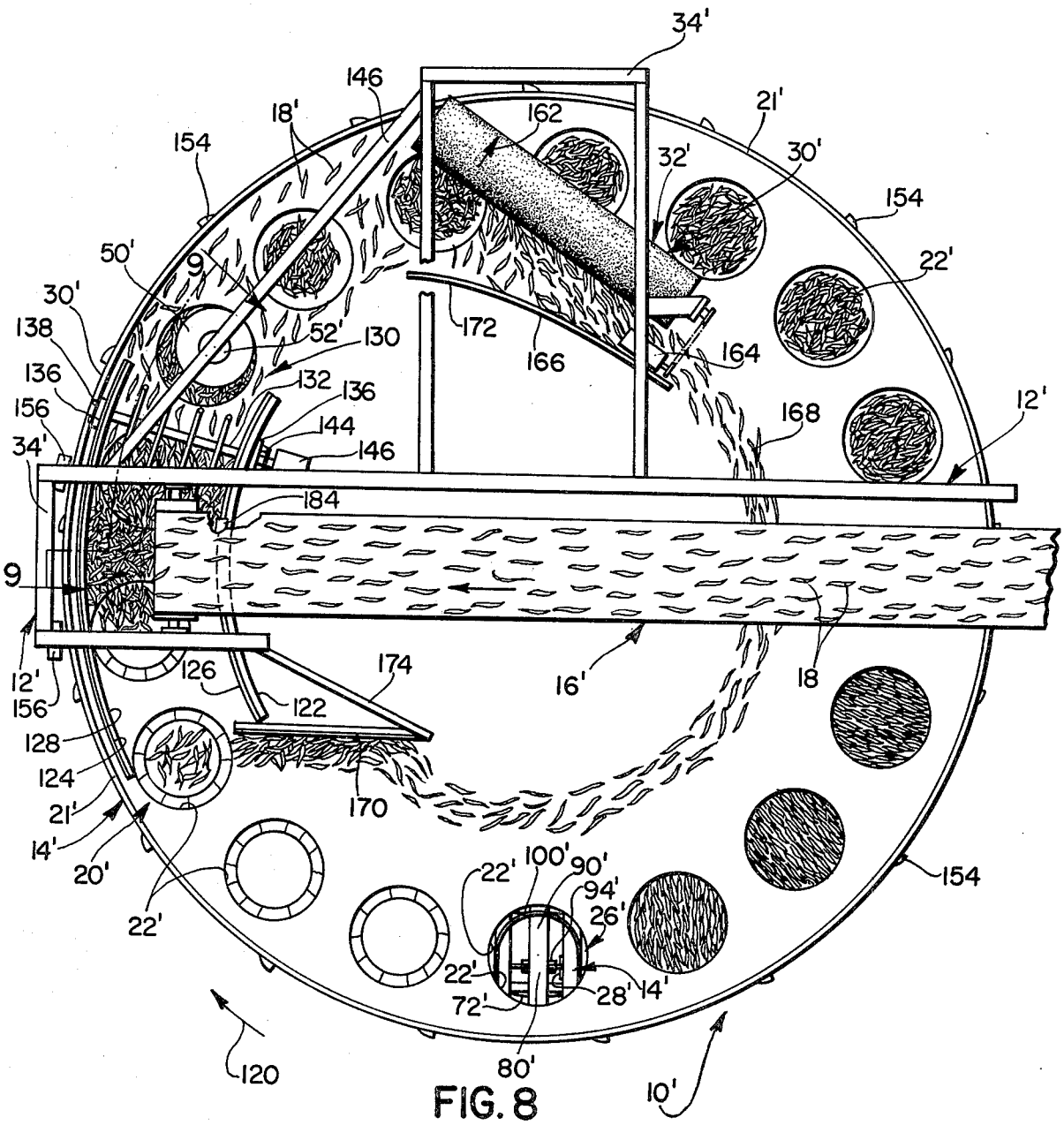
FIG. 8 is a schematic, top view of the apparatus shown in FIG. 7 with parts broken away and removed for clearer illustration.

A preferred embodiment of the filling apparatus is shown in FIGS. 7-9 where in reference numerals primed, as 10', in FIGS. 7-9, and in the following description indicate similar or identical parts to those indicated by the unprimed reference numerals, as 10, in the embodiment illustrated and described with reference to FIGS. 1-6. Such parts as are common to both embodiments may or may not be described hereinafter or indicated by reference numerals in FIGS. 7-9.

The container filling apparatus 10' illustrated in the preferred embodiment of FIGS. 7-9 includes a turntable unit 14' mounted on a base unit 12' for rotation about a generally vertical axis in the same manner as shown and described with reference to the embodiment of FIGS. 1-6. Any suitable form of a conveyer, such as the belt conveyer 16' shown in FIGS. 7-9 may be provided, and as shown conveyer 16' has a lower right hand receiving end spaced outwardly from the right side of the turntable unit 14' as shown in FIGS. 7 and 8, for receiving the beans in generally parallel orientation as may best be seen in FIG. 8. Conveyer 16' carries these beans to its elevated, discharge end positioned above the series of ports 22' in the turntable 20'; each of the ports 22' having a depending annular lip 106' (FIG. 7) which is received within the open top of a suitable container such as a conventional hamper 24', as previously described. Hampers 24' are carried on an elevating system 26' which is mounted on the turntable unit 14' for rotation therewith in the direction indicated by the arrow 120 in FIGS. 7-9, which is clockwise and opposite the direction of rotation of the turntable unit 14 shown in FIG. 1-6. Each hamper 24' is received on an association platen 80' having an upward extending generally U-shaped vertical wall 100' for receiving the base of the hamper when the platen 80' is in its lower position 90' shown in FIG. 8, and upon continued rotation of the turntable 20' the platen and its hamper are elevated so that the open upper end of the hamper receives the depending annular wall 106' of the port 22' with the upper portion of the hamper urged against guides 104' in a manner previously described. Upon completely one rotation with the turntable unit 14', is lowered to the position 90' shown in FIGS. 7 and 8, and is removed from the filling apparatus 10'.

As the beans 18' drop from the discharge end of the belt conveyer 16', they fall between radially spaced apart segmental cylindrical walls including an inner wall 122 and outer wall 124, and fall into the turntable ports 22' between these two walls and also drop surface of the turntable 20' between the ports 22'. Lower portions of the walls 122 and 124 are slightly spaced above the top surface of the turntable 20' and have secured thereto resilient bands 126 and 128, respectively, which lightly engage the top surface of the turntable 20' to prevent the beans from passing beneath or being wedged between the lower ports of these walls and the turntable 20'. Walls 122 and 124 are preferably fixidly secured to and depend from portions of the top frame unit 34' of the base unit 12'.

The beans 18' which have dropped from the belt conveyor 16' between the walls 122 and 124 and on to the top surface of the turntable 20' or through the adjacent ports 22' and into the hampers 24' move in a clockwise direction, as indicated by the arrow 120, with the turntable assembly 14' and to a first portion of the propelling assembly 30' in the form of a rotary fork unit 130 (FIG. 9). Rotary fork unit 130 propells the beans 18' in a direction away from itself and back toward the area between the walls 122 and 124 at which the beams were dropped, in order to level any mounds of beans traveling with the turntable unit 14' and to move the beans to the ports 22'.

Rotary fork unit 130 includes a generally horizontal axle 132 having opposite end portions extending through vertically elongated slots 134 in the side walls 122 and 124, these opposite end portions of the axle being received in journals 136 (FIG. 8) and adjustably secured by nuts and bolts 138 extending through pairs of elongated slots 140 in adjacent ones of the side walls 122 and 124 so that the elevation of the fork may be adjusted relative to the top surface of the turntable 20'. Axle 132 is rotated in a counterclockwise direction as indicated by the arrow 142 in FIG. 9, by a suitable chain drive 144 and an electric motor 146 (FIG. 8) preferably mounted on the upper frame unit 34'. As the axle 132 is rotated, tines 148 which are each about ten inches long and generally radially fixed to the axle 132, flip the beans 18' opposite the direction of rotation of the turntable unit 14' and generally back under the discharge end of the belt conveyer 16', thus leveling any mounds of beans on the turntable 20' and facilitating the beans passing through the adjacent ones of the ports 22' and into the hampers 24'. About two inches of outer ends of the tines 148 are preferably bent to define an included angle of about 150° in a direction opposite the direction of rotation, as shown in FIG. 9, to reduce the possibility of bruising the beans. As shown in the drawings, four sets of axiliated space tines 148 are illustrated, each set having radially extending tines equally spaced from each other. The sets of tines are spaced apart sufficiently so that a portion of the beans pass therebetween as well as between outer ends of the tines and the top face of the turntable 20', and therefore the rotary fork permits passage of the beans 18' with the turntable unit 14'.

As the turntable unit 14' moves a short distance past the rotary fork unit 130, the beans are compacted in the hampers 24' by a compactor assembly 50' (FIGS. 8 & 9). The compactor 50 of the embodiment of FIGS. 1–7 is preferably the same as the embodiment now to be described and includes a generally cylindrical disc shaped compacting head 54' fixes on the free end of a piston rod which is part of a doubleacting hydraulic cylinder 52, for example. The upper end of cylinder 52 has a pivotal connection 144 fixidly secured to a rigid rail 146 which in turn is fixed at its opposite ends to appropriate portions of the upper frame unit 34'. Pivotal connection 144 is preferably provided with an adjustable stop 148 so that the normal upright position of the cylinder 52' and its piston rod and the compacting head 54' may be adjusted for accurate entry through the ports 22' and into the hampers 24', the assembly being releasable retained in this normal position by a pair of tension springs 150 secured at their lower ends to the top of the compacting head 54' on opposite sides of the piston rod, and at their upper ends secured to the opposite sides of the rail 146, thus permitting the compactor assembly 50' to swing from its solid line position as shown in FIG. 9 to the inclined phantom line position should an inerference occur between the compactor assembly 50' and the turntable unit 14'. As soon as the interference has been eliminated, the springs 150 return the compactor assembly 50' to its normal, solid line position, as shown in FIG. 9. Compactor assembly 50' may be controlled in any suitable manner so that the compactor head 54' is depressed from the retracted upper solid line position in FIG. 9 to the extended line phantom line position when a port 22' and its associated hamper 24' are in proper position to receive the head 54'. A preferred form of such control includes a plurality of beveled cams 154, one for each of the ports 22', the cams 154 being opporatively fixed to a peripheral portion of the turntable unit 14' in position to engage a cam follower of a cooperating sensor 156 operatively fixed to the top base unit 34' as illustrated in the left hand portion of FIG. 8. The sensor unit 156 is preferably mounted for adjustable movement in the direction of movement of the turntable unit 14' in order to accurately syncronize downward movement the compactor head 54' with proper positioning of the associated port 22'. Any suitable sort of sensor and control generally may be utilized, for example a hydraulic valve sensor 156 may be connected directly with the hydraulic cylinder 52', or if desired an electrical sensor 156 may be connected in circuit for accuating a hydraulic valve connected with the hydraulic cylinder 52'. The stroke of the compacting head 54' may be adjusted in keeping with typical adjustment of such equipment, and the force supplied contracting head is preferably just sufficient to eliminate any voids between the beans rather than to compress the individual beans, thus leaving the beans in tact.

After leaving the compactor area, some beans 18' are still carried on the top surface of the turntable 20' and these beans pass to a second portion of the propelling assembly 30', herein illustrated in the form of a rotary brush 32', with the tensil modulus of the bristles being approximately 400,000 psi. Opposite ends of the brush 32' are mounted in journals fixidly secured to legs, as 160 fixidly depending from the upper frame unit 34' and positioning the brush axially disposed generally as shown in FIG. 8 with the cylindrical periphery of the brush lightly touching the top surface of the turntable 20', as previously described. Brush 32' is rotated in the direction of the arrow 162 (FIGS. 7 & 8) to engage the beans and move them away from the brush and upstream opposite the direction of rotation of the turntable 20', by means of a suitable motor and chain drive assembly 164 (FIGS. 7 & 8). As the beans are propelled by the rotary brush 32' they continue to be moved in a clockwise direction by the turntable 20' and are moved to a position between the brush and a generally arcuate wall 166 against which the beans collect and continue to be moved with the turntable 20' into a generally annular path 168 along the top surface of the turntable and these beans are carried to a generally vertical wall 170 which guides the beans back into the path of the ports 22' and into empty hampers 24' which have just been inserted into the elevating assembly from which the hampers and these beans are passed to below the discharge end of the belt conveyor 16', and the previously described cycle is repeated. Wall 166 is preferably fixedly suspended, as by legs 172, from the upper frame unit 34', and wall 170 is preferably suspended, as by an arm 174 operatively fixed to the upper frame unit 34' and carrying a leg fixedly secured to the wall 170. The outer end of the wall 170 is preferably fixedly secured to the adjacent end of the wall 122. Walls 166 and 170 are preferably provided with resilient bands, as 126 or 128 previously described with reference to walls 122 and 124, respectively.

The speed of the belt conveyor 16' and the turntable 20' should be coordinated to provide a relatively uniform flow of beans 18' through the ports 22' and into the hampers 24' and this may be accomplished in any suitable manner known in the art. A turntable rotational velocity of about one rpm, for example, is normally adequate.

Turntable 14' is preferably automatically rotated step by step and is stopped to overfill each hamber 24' before the hamper moves downstream from the belt conveyor 16' to the rotary fork unit 130 which propells most of the overfill back toward the conveyor 16'. This may be accomplished in any suitable manner as by an optical unit 180 mounted on the outer wall 124 and including a light source for projecting a beam about four and a half inches above the the turntable 20' and to a reflector 182 on the inner wall 122 which reflects the beam back to a photo-electric sensor of the unit 180. Thus, when the beam is broken by a mound of beans atop the hamper 24', the sensor is de-actuated in a suitable circuit to turn on the turnable motor (as 74, FIG. 3) and move this overfilled hamper to the rotary fork unit 130. When the beam is uninterrupted, the motor and turntable are stopped until a newly dropped mound of beans again breaks the beam.

Vertical adjustment of the rotary fork unit of between one-half and two inches is adequate, and a minimum spacing of about one inch between the tines and the top surface of the turntable 20' is preferable to provide about an inch overfill of the hamper as it is received by the compactor 50'.

Compacting of the beans 18' in each hamper 24' is in direct proportion to the pressure applied to the beans by the compactor head, and depending on the size and type of beans being loaded a pressure of 40–150 psi reasonable for an inside diameter of the cylinder 54' of two and one-half inches. Pole beans are normally four to seven inches long, and the longer the beans the higher the required pressure to provide the desired compacting. Similarly, lighter density beans require a high pressure.

The rotational speed of the rotary fork unit 130, by way of example, may be about 44 rpm, and that of the rotary brush 32' may be about 92 rpm, and these speed may be independently adjusted to substantially assure that the hampers 24' will be filled upon leaving the vicinity of the rotary brush 32' and ready for unloading as the platen 80' carrying the hamper is dropped to its low position 90' for removal of the filled hamper and insertion of an empty hamper 24'.

During adjustment of the component speeds and the compactor pressure, it may be necessary to manually fill the tops of the hampers 24', and this may be accomplished as the hampers pass from under the right hand end of the belt conveyor 16', by an attendant hand loading the hampers with beans from the belt conveyor 16'. Additionally, some buyers prefer that the top layer of beans in the hampers are parallel to each other, and since beans 18' are normally delivered to the belt conveyor 16' in parallel orientation it is a relatively simple matter for an attendant to hand load a layer of parallel beans at the top of each hamper.

To summarize the operation of the container filling apparatus shown in FIGS. 7–9, it should first be noted that the apparatus 10' is adaptable for handling various different types of containers as discussed with reference to the first embodiment, and as matter of convenience is illustrated and described as handling the typical bean hampers 24'. Starting at the station in which a platen 80' of the elevating system 26' is at its lowered position 90' (FIG. 8), a filled hamper 24' has been removed from the platen and an empty hamper is to be inserted onto the platen. As the turntable unit 14' continues rotation in a clockwise direction, as indicated by the arrow 120, the empty hamper 24' is elevated on its platen 80' and the hamper rim is seated about the annular wall 106' along the periphery of the associated port 22'. Continued movement of the hamper 24' with the turntable 14' moves the empty hamper to the outer end of the wall 170 at which location beans 18' which have traveled with the annular path 168 on the top surface of the turntable 20' are urged by this wall into the empty hamper which then continues its movement to directly below the elevated discharge end of the belt conveyor 16' at which location beans are dropped through the port 22' and into the hamper 24' and also onto the top surface of the turntable 20' adjacent the port 22'. In order to maintain the overfill of the beams 18' substantially constant on each of the hampers 24', each hamper continues its movement with the turntable to the rotary fork 130 which propels the beans 18' away from itself and in a direction back toward the drop area of the beans from the belt conveyor 16' and also propels these beans into the ports 22' and the associated hampers. At this point the hampers are overfilled about an inch, and moved to the compactor 50' which is automatically actuated to lower its compacting head 54' through the aligned port 22' and into the hamper 24' in order to substantially eliminate any voids between the beans, whereupon the compactor head is withdrawn and the hamper continues onward toward the rotary brush 32'. Beans are still on the top surface of the turntable 20' between the ports 22' and as these beans are engaged by the rotary brush 32' they are propelled away from the rotary brush and back over approaching port 22' and simultaneously continue to move with the turntable 20' so that beans 18' remaining on the top surface of the turntable are propelled into engagement with the curved wall 166 which ultimately deposits these beans into the arcuate path 168 and the beans are carried back to the previously mentioned wall 170 which then causes the beans to be deposited in empty hampers newly inserted into the elevating system of the filling apparatus. If desired, an attendant may be stationed at the receiving end of the belt conveyor 16' for handloading the tops of the hampers if necessary, and for providing a substantially parallel top layer of beans in the hamper, if desired.

While this invention has been described and illustrated with reference to particular embodiments in a particular environment, various changes may be apparent to one skilled in the art and the invention is therefore not to be limited to such embodiments or environment, except as set forth in the appended claims.

What is claimed is:

1. Container filling apparatus for filling a container with a mass of discrete units of material comprising, conveyor means having surface means for receiving the material to be loaded into the container and further having means for moving said surface means in a predetermined first direction, spaced apart port means in said surface means for passage therethrough of the material, said port means being along a path extending generally in said first direction, means for positioning the container in communication with said port means to receive the material, means for propelling the material along said surface means in a second direction generally opposite that of said first direction for levelling the material above the top of the container; and a compression head engageable with the material in the container for compacting the units of material in the container to reduce voids therein; said conveyor means being a turntable and said surface means being a generally horizontal surface of said turntable for receiving the material to be loaded into the containers, said port means being a series of ports spaced apart along a circular path proximate the periphery of and substantially coaxial with the rotational axis of the turntable, said first direction being a generally downstream direction and said second direction being a generally upstream direction, the moving means rotating said turntable in said downstream direction about said axis, and the container positioning means providing means for positioning the containers below and in communication with said ports; said propelling means including first and second propelling means in which an inner extremity of the first propelling means being adjacent to and spaced from the turntable axis for defining a central area about said turntable axis, and said first propelling means and said turntable together providing means for moving the material in a direction nearer to said turntable axis and into said central area with the material in said central area positioned to bypass said first propelling means, and said second propelling means being downstream of said first propelling means and extending into said central area for receiving the material in said central area and for propelling the last said material as aforesaid and into said ports.

2. Apparatus as set forth in claim 1 in which said first propelling means includes a rotary brush adjacent and facially opposed to said turntable surface for moving the material as aforesaid.

3. Apparatus as set forth in claim 1 in which said second propelling means includes a rotary brush adjacent and facially opposed to said turntable surface for moving the material as aforesaid.

4. Apparatus as set forth in claim 1 in which the first and second propelling means each include a rotary brush adjacent and facially opposed to and lightly engaging said turntable surface for propelling said material as aforesaid, and the rotational axes of said brushes are substantially parallel to each other.

5. Apparatus as set forth in claim 1 in which said first propelling means includes a rotary fork for leveling said material on said turntable and propelling said material as aforesaid and for by-passing a portion of said material to said second propelling means, and means for adjusting the distance between said fork and said turntable for varying the leveling of said material above the container, and said moving means moves said turntable step by step.

6. Container filling apparatus for filling a container with a mass of discrete units of material comprising, conveyor means having surface means for receiving the material to be loaded into the container and further having means for moving said surface means in a predetermined first direction, spaced apart port means in said surface means for passage therethrough of the material, said port means being along a path extending generally in said first direction, means for positioning the container in communication with said port means to receive the material, means for propelling the material along said surface means in a second direction generally opposite that of said first direction for leveling the material above the top of the container; and a compression head engageable with the material in the container to reduce voids therein; said propelling means being a rotary fork for propelling said material aforesaid and bypassing a portion of said material above the top of the container.

7. Apparatus as set forth in claim 6 in which said fork has a generally horizontal rotational axel with axially spaced sets of tines extending outwardly therefrom.

8. Apparatus as set forth in claim 7 in which said propelling means includes means for rotating said fork, said tines extend generally radially of said axel to outer ends extending in a direction generally opposite the direction of rotation of said fork.

9. Apparatus as set forth in claim 1 in which the container positioning means is operable for positioning of empty containers in communication with said ports at a first location upstream of a second location at which said propelling means guides said material into said ports.

10. Apparatus as set forth in claim 9 including a conveyor for delivering the material to said turntable between said second location and said first positioning means and said conveyor extending therefrom across said turntable to a position between said first guide means and said first location, and the last said position being at an elevation relative to said turntable to facilite manual loading of said material from said position into adjacent ones of said ports.

11. Container filling apparatus for filling a container with a mass of discrete units of material comprising, conveyor means having surface means for receivig the material to be located into the container and further having means for moving said surface means in a predetermined first direction, spaced apart port means in said surface means for passage therethrough of the material, said port means being along a path extending generally in said first direction, means for positioning the container in communication with said port means to receive the material, means for propelling the material along said surface means in a second direction generally opposite that of said first direction for leveling the material above the top of the container; and a compression head engageable with the material in the container for compacting the units of material in the container to reduce voids therein; said conveyor means being a turntable and said surface means being a generally horizontal surface of said turntable for receiving the material to be loaded into the containers, said port means being a series of ports spaced apart along a circular path proximate the periphery of and substantially coaxial with the rotational axis of the turntable, said first direction being a generally downstream direction and said second direction being a generally upstream direction, the moving means rotating said turntable in said downstream direction about said axis, and the container positioning means providing means for positioning the containers below and in communication with said ports; said propelling means being a rotary brush extending across the path of said ports and positioned for propelling said material generally inwardly of said turntable and generally into said ports with material remaining on said turntable being propelled toward first guide means for receiving the last said material and guiding the material into a generally circular path on said turntable, and second guide means for receiving the material from the last said path and guiding the material into said ports.

12. The method of filling a container with a mass of units of an elongated material, comprising the steps of:

positioning the container in communication with a port in a horizontal surface;

depositing the material through the port to fill the container;

continuing depositing material to a level above the upper termination of the container;

compressing the material into the container to compact the mass of material in the container to reduce the voids therein; and propelling the material along the horizontal surface in a direction generally opposite to the direction of movement of the horizontal surface.

13. The method as set forth in claim 12 in which the step of propelling the beans removes excess beams from atop the ports.

14. The method as set forth in claim 12 in which the step of propelling the material includes the step of leveling the material immediately downstream of the area in which the container initially receives the material by propelling the material as aforesaid and into said ports.

15. The method as set forth in claim 12 in which the step of propelling the material comprises guiding the material remaining on the horizontal surface after passage of at least a portion of the material into said ports, along a path into ports immediately upstream of the area in which the container initially receives the material.

16. The method as set forth in claim 10, wherein the step of positioning the container comprises rotating a turntable having a plurality of ports disposed about the outer circumference thereof.

17. The method as set forth in claim 16 in which the propelling step propells a portion of the material to a generally central position nearer the rotational axis of the turntable and then propels the material from the central position into the ports.

18. Container filling apparatus for filling a container with a mass of discrete units of material comprising, conveyor means having surface means for receiving the material to be loaded into the container and further having means for moving said surface means in a predetermined first direction, spaced apart port means in said surface means for passage therethrough of the material, said port means being along a path extending generally in said first direction, means for positioning the container in communication with said port means to receive the material, means for propelling the material along said surface means in a second direction generally opposite that of said first direction for leveling the material above the top of the container; said conveyor means being a turntable and said surface means being a generally horizontal surface of said turntable for receiving the material to be loaded into the containers, said port means being a series of ports spaced apart along a circular path proximate the periphery of and substantially coaxial with the rotational axis of the turntable, said first direction being a generally downstream direction and said second direction being a generally upstream direction, the moving means rotating said turntable in said dowstream direction about said axis, and the container positioning means providing means for positioning the containers below and in communication with said ports; said propelling means including first and second propelling means in which an inner extremity of the first propelling means being adjacent to and spaced from the turntable axis for defining a central area about said turntable axis, and said first propelling means and said turntable together providing means for moving the material in a direction nearer to said turntable axis and into said central area with the material in said central area positioned to bypass said first propelling means, and said second propelling means being downstream of said first propelling means and extending into said central area for receiving the material in said central area and for propelling the last said material as aforesaid and into said ports.

* * * * *

UNITED STATES PATENT AND TRADEMARK OFFICE

CERTIFICATE OF CORRECTION

PATENT NO. : 4,192,359

DATED : March 11, 1980

INVENTOR(S) : Roy L. Pippin

It is certified that error appears in the above-identified patent and that said Letters Patent are hereby corrected as shown below:

Col. 1, line 61, after "sleeves" insert --on--;
line 63, "capable" should be --capsule--;
Col. 4, line 26, after 3- insert --3--;
Col. 5, line 26, "beams" should be --beans--;
Col. 8, line 4, "completely" should be --completing--;
line 5, after "14" insert --each hamper 24'--;
line 12, after "drop" insert -- unto the top --.
line 19, "ports" should be --portions--;
line 63, insert --four-- before "radially";
Col. 10, line 37, "delete "hamber" and insert --hamper--;
line 63, after "psi" insert --is--;
Col. 11, line 47, delete "beams" and isnert --beans--;
Col. 13, line 60, delete "located" and insert --loaded--;
Col. 14, line 42, delete "beams" and insert --beans--.

Signed and Sealed this

*Eighth* Day of *July 1980*

[SEAL]

*Attest:*

SIDNEY A. DIAMOND

*Attesting Officer*

*Commissioner of Patents and Trademarks*